US005327840A

United States Patent [19]

Tajima et al.

[11] Patent Number: 5,327,840

[45] Date of Patent: Jul. 12, 1994

[54] THREAD TAKE-UP LEVER DRIVING DEVICE IN SEWING MACHINE

[75] Inventors: Ikuo Tajima; Satoru Suzuki; Youichi Mizuguchi, all of Anjo, Japan

[73] Assignee: Tokai Kogyo Mishin Kabushiki Kaisha, Kasugai, Japan

[21] Appl. No.: 977,841

[22] Filed: Nov. 17, 1992

[30] Foreign Application Priority Data

Nov. 18, 1991 [JP] Japan ..... 3-330019

[51] Int. Cl.[5] ..... D05B 19/00; D05C 11/00

[52] U.S. Cl. ..... 112/121.11; 112/241

[58] Field of Search ..... 112/121.11, 241, 57, 112/96, 242, 243, 246, 244, 245, 247

[56] References Cited

U.S. PATENT DOCUMENTS 886,574 5/1908 Ammerman ..... 112/246 X 1,101,002 6/1914 Zahn ..... 112/96

4,295,433 10/1981 Desprez et al. ..... 112/241

4,412,497 11/1983 Teetz et al. ..... 112/96

4,719,865 1/1988 Yokoe et al. ..... 112/221

5,189,971 2/1993 Frankel et al. ..... 112/121.11 X

*Primary Examiner*—Clifford D. Crowder

*Assistant Examiner*—Paul C. Lewis

*Attorney, Agent, or Firm*—Dennison, Meserole, Pollack & Scheiner

[57] ABSTRACT

In a sewing machine having a needle bar and a shuttle driven by a main shaft and having a thread take-up lever vertically reciprocally movable in response to movement of the needle bar and the shuttle, a thread take-up lever driving device include a stroke adjusting device for adjusting a vertical stroke of the thread take-up lever in response to change of the sewing operation or in response to the material of a work fabric to be sewn.

6 Claims, 11 Drawing Sheets

THREAD TAKE-UP LEVER DRIVING DEVICE IN SEWING MACHINE

BACKGROUND OF THE INVENTION

1. Field of the Invention

The present invention relates to a thread take-up lever driving device in a sewing machine such as an embroidery machine.

2. Description of the Prior Art

In a conventional thread take-up lever driving device, a normal sewing operation is performed in such a manner that a thread take-up lever is pivoted downwardly to loosen an upper thread when the upper thread is engaged by a hook of a shuttle and is withdrawn into the shuttle; the thread take-up lever is pivoted upwardly to tighten the upper thread after the upper thread has been removed from the shuttle; and the thread take-up lever is further pivoted upwardly to draw out the upper thread from an upper thread supply device. The pivotal stroke of the thread take-up lever is determined to a minimum distance required for performing this operation.

Here, it will be noted that each stitch sewn by a conventional sewing machine has a relatively short length. Although it has been proposed to adjust the length of the stitch to some extent, the adjusting range is relatively small. Therefore, when the pivotal stroke of the thread take-up lever is determined to correspond to an average stitch length, variations of the stitch length can be compensated to some extent by adjusting a tension adjusting device which is operable to adjust the tension of the upper thread, so that a proper thread-tightening operation can be performed.

On the other hand, each stitch sewn by a conventional embroidery machine has a relatively long length such as 0.1 mm to 12.7 mm, and in many cases, each stitch is controlled to have a different length from other stitches. Therefore, even if the pivotal stroke of the thread take-up lever has been determined to correspond to an average stitch length, the variations of tension of the upper thread may exceed the limit of adjustment of the tension adjusting device when the stitch length is too small or too large. This may cause excessive tightening of the thread or insufficient tightening, resulting in that the appearance of the stitches is degraded.

SUMMARY OF THE INVENTION

It is, accordingly, an object of the present invention to provide a thread pick-up lever driving device in a sewing machine which permits formation of proper stitches having excellent appearance in response to a sewing situation or in response to a material to be sewn.

According to the present invention, there is provided a thread take-up lever driving device in a sewing machine having a needle bar and a shuttle driven by a main shaft and having a thread take-up lever vertically reciprocally movable in response to movement of the needle bar and the shuttle, comprising a stroke adjusting device for adjusting a vertical stroke of the thread take-up lever in response to change of the sewing operation or in response to the material of a work fabric to be sewn.

The invention will become more fully apparent from the claims and the description as it proceeds in connection with the drawings.

DETAILED DESCRIPTION OF THE PREFERRED EMBODIMENTS

A first embodiment of the present invention will be now be explained with reference to FIGS. 1 to 9.

Figure 1:
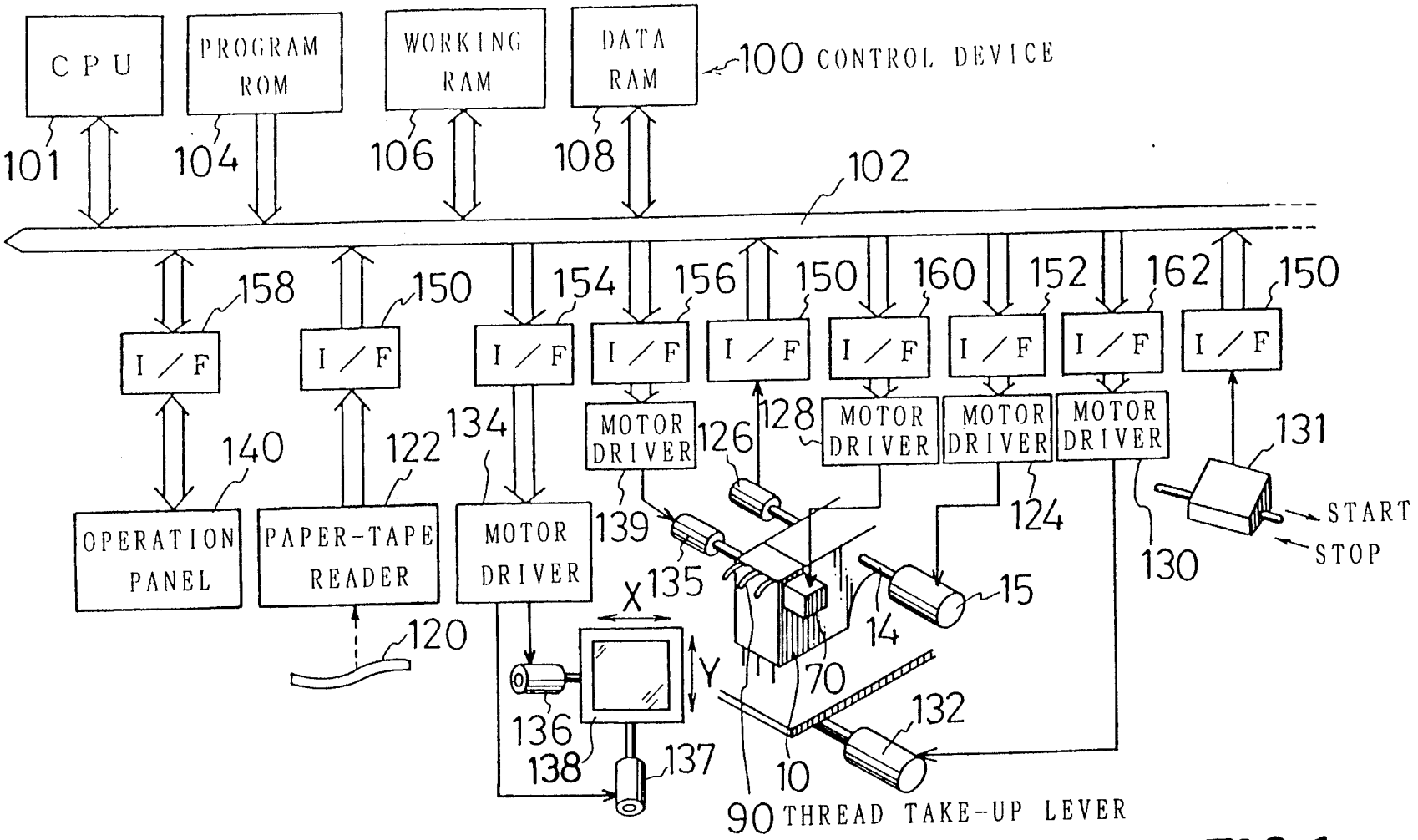
FIG. 1 is a schematic block diagram of a control mechanism of a sewing machine incorporating a thread take-up lever driving device according to a first embodiment of the present invention.

Referring to FIG. 1, there is shown a schematic block diagram of various control devices of a sewing machine. A CPU 101 is a mainstay element of a embroidery control device 100 and is connected to a program ROM 104, a working RAM 106 and a data RAM 108, respectively, through a bus line 102.

Further, an interface 150 is connected to the CPU 101 through the bus line 102. A data signal from a paper-tape reader 122 which reads out a data of an embroidery pattern written in a paper tape 120, an output signal from an encoder 126 which detects the rotational angle of a main shaft 14, and an on-off signal from a sewing start switch 131 which is operated by an operator are converted by the interface 150 into corresponding signals which are appropriate for inputting to the CPU 101, respectively.

An interface 152 outputs a control signal for a motor driver 124 of a main shaft motor 15 which drives the main shaft 14. An interface 154 outputs a control signal for a motor driver 134 of embroidery frame drive motors 136 and 137. An interface 156 outputs a control signal for a motor driver 139 of a color change motor 135 which slidably moves a needle bar case 50. An interface 160 outputs a control signal for a motor driver 128 of a thread take-up lever drive motor 70. An interface 162 outputs a control signal for a motor driver 130 of a shuttle drive motor 132. These interfaces 152, 154, 156, 160 and 162 are also connected to the CPU 101 through the bus line 102.

An operation panel 140 is equipped with various operation keys and indicators. An interface 158 of the operation panel 140 is also connected to the CPU 101 through the bus line 102.

Figure 2:
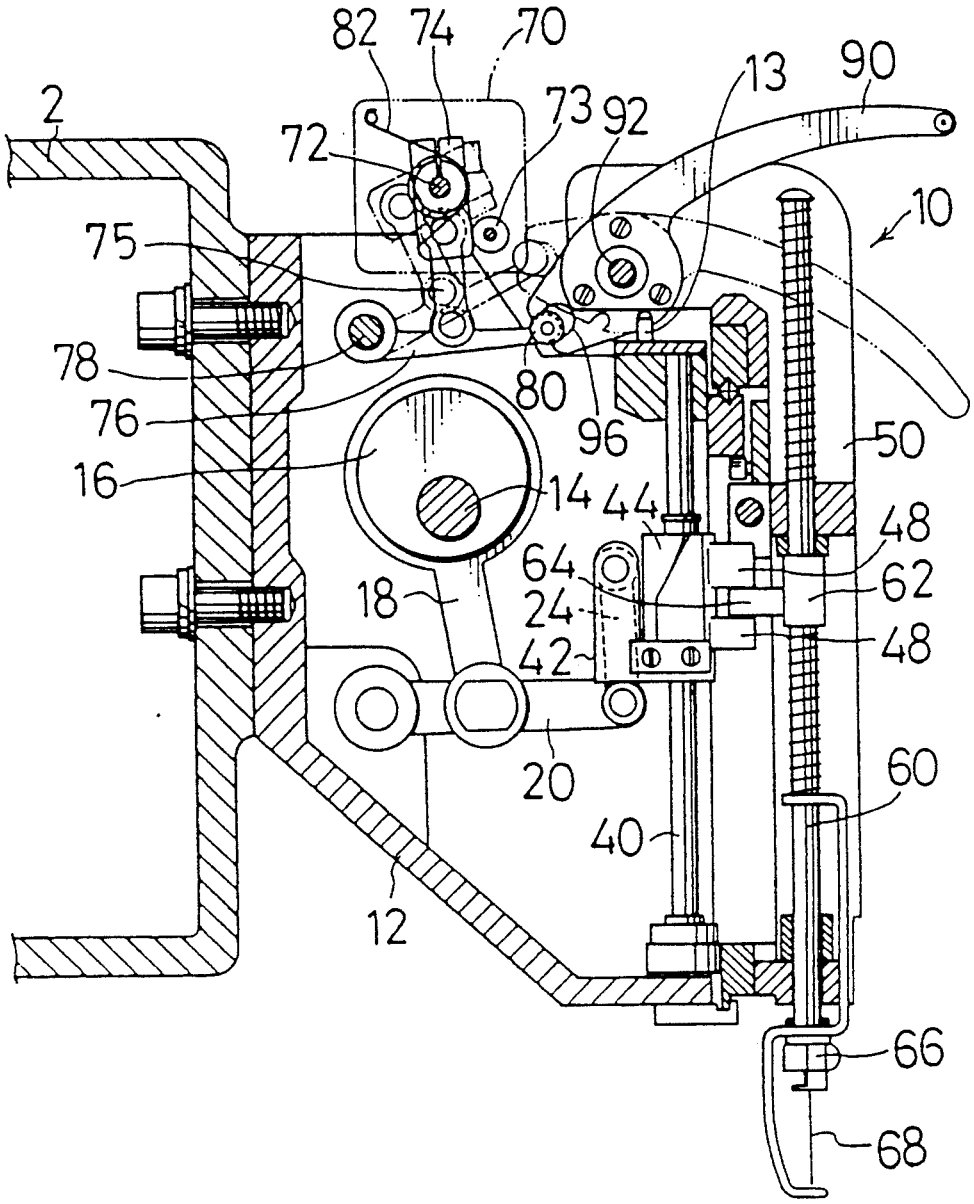
FIG. 2 is a vertical sectional view of a sewing head incorporating the device shown in FIG. 1.

A vertical sectional view of a sewing head 10 is shown in FIG. 2. A machine frame 2 includes a machine arm 12 through which the main shaft 14 extends. The main shaft 14 is continuously driven by the main shaft motor 15. A needle bar drive cam 16 is fixed to the main shaft 14.

A base needle bar 40 is disposed on the front side of the machine arm 12. A drive base 42 is mounted on the base needle bar 40 and is slidably movable together with a needle bar drive member 44 along the base needle bar 40 in a vertical direction. The needle bar drive member 44 includes a pair of engaging protrusions 48 disposed in a vertical direction relative to each other on the front side of the machine arm 12.

The rotation of the needle bar drive cam 16 is transmitted to a needle bar drive lever 20 through a connecting rod 18. One end of the needle bar drive lever 20 is pivotally connected to a part of the machine arm 12. The other end of the needle bar drive lever 20 is connected to the drive base 42 through a link member 24. Thus, as the needle bar drive cam 16 rotates, the drive base 42 is moved together with the needle bar drive member 44 along the base needle bar 40 through the connecting rod 18, the needle bar drive lever 20 and the link member 24.

Figure 3:
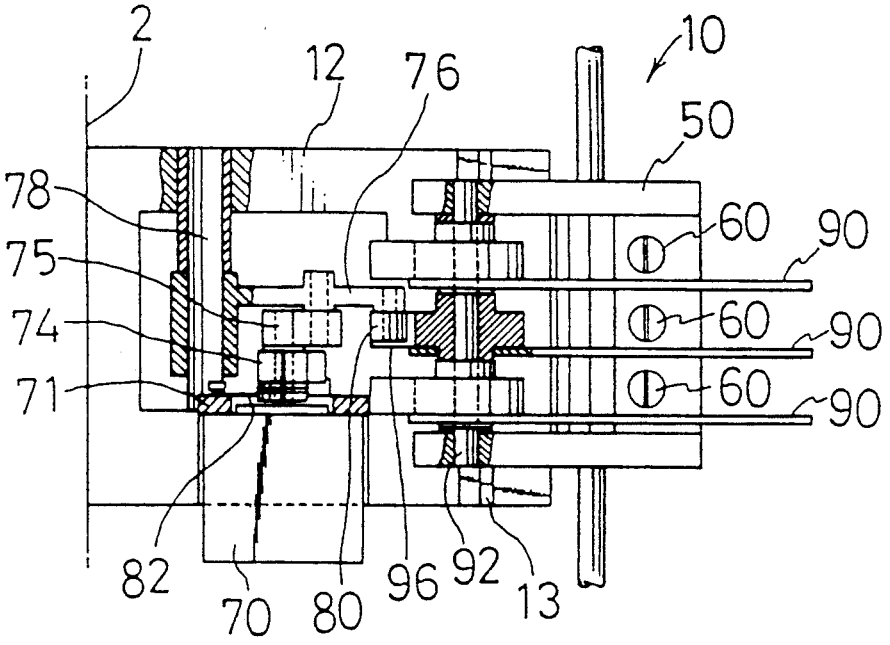
FIG. 3 is a plan view, with a part broken away, of the sewing head shown in FIG. 2.

FIG. 3 shows a plan view, with a part broken away, of the sewing head 10. As will be seen from FIG. 3, the needle bar case 50 is mounted on the front side of the machine arm 12. The needle bar case 50 is slidably movable in a lateral direction under control of the color change motor 135.

A plurality of needle bars 60 (three in this embodiment) are vertically movably mounted on the needle bar case 50 and are disposed along the direction of sliding movement of the needle bar case 50. A needle bar holder 62 is fixed to each needle bar 60 and includes a pin 64 engageable with the engaging protrusions 48 of the needle bar drive member 44. A sewing needle 68 is mounted on the lower end of each needle bar 60 through a needle stopper 66. A thread take-up lever shaft 92 is disposed in parallel to the main shaft 14 at a position adjacent the upper portion of the needle bar case 50. Thread take-up levers 90 of the same number as the needle bars 60 are reciprocally pivotally mounted on the thread take-up lever shaft 92. Each thread take-up lever 90 includes a boss portion which has recesses 94 and 96 on its periphery.

The recess 94 is in engagement with a stopper rail 13. The stopper rail 13 is mounted on the machine arm 12 and extends over the range of sliding movement of the needle bar case 50, so that each thread take-up lever 90 is maintained at a position indicated by a solid line in FIG. 2. The recess 96 is engageable with a roller 80 mounted on one end of a drive lever 76 for the thread take-up levers 90 as will be hereinafter explained.

When the needle bar case 50 is slidably moved relative to the machine arm 12 under control of rotation of the color change motor 135, the pin 64 of any one of the needle bars 60 is selectively engaged between the engaging protrusions 48 of the needle bar drive member 44. One of the needle bars 60 thus selected is therefore moved vertically in response to the vertical movement of the needle bar drive member 44.

Simultaneously, the roller 80 of the drive lever 76 engages the recess 96 of the thread take-up lever 90 of the selected one of the needle bars 60 through which an upper thread (not shown) is passed, and the recess 94 of the selected one of the needle bars 60 is positioned at a notched part of the stopper rail 13, so that the thread take-up lever 90 of the selected one of the needle bars 60 can be pivoted around the thread take-up lever shaft 92 in response to the pivotal movement of the drive lever 76 as will be explained later.

Figure 4:
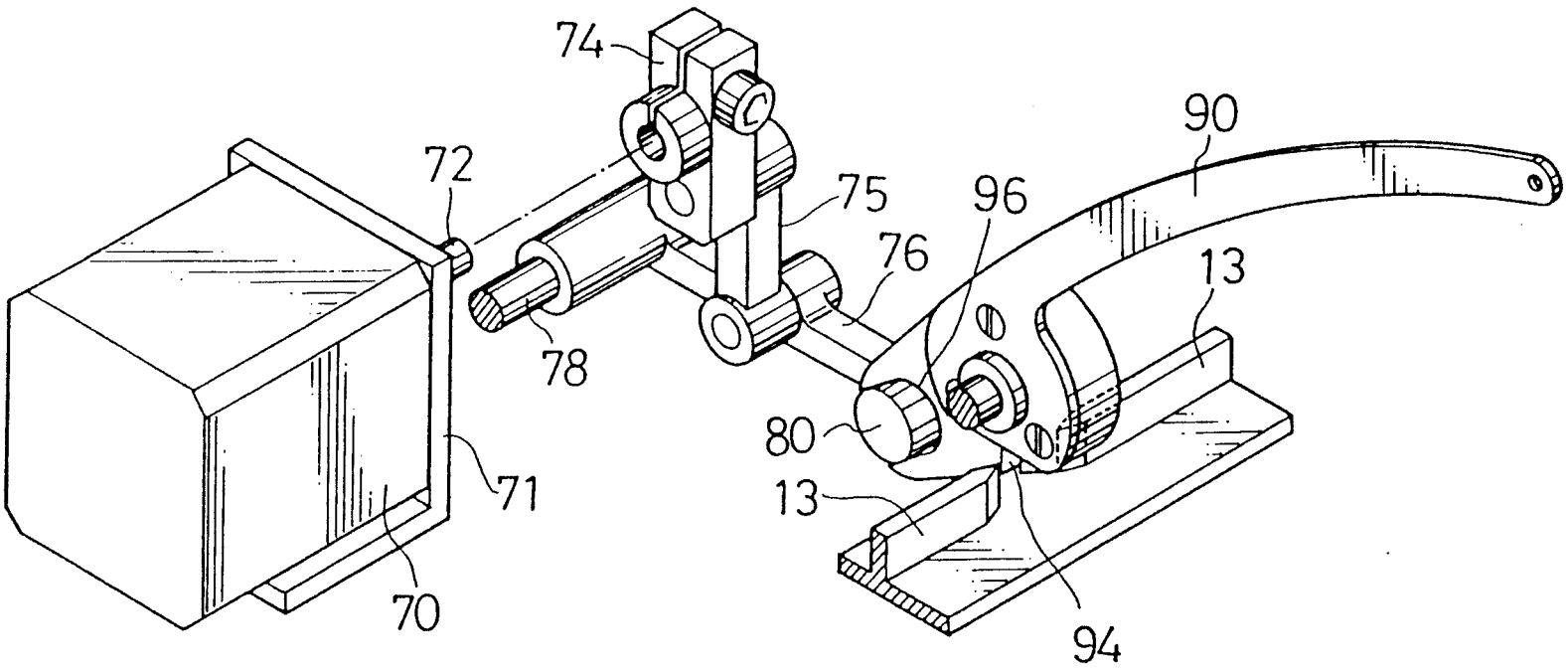
FIG. 4 is a perspective view of a main part of the mechanism shown in FIG. 1.

FIG. 4 shows a main part of the thread take-up lever driving device in perspective view. As will be seen from FIG. 4, one end of the drive lever 76 is pivotally supported by a support shaft 78 which is fixed to the machine arm 12 at both ends. The roller 86 is rotatably mounted on the other end of the drive lever 76 and is in engagement with the recess 96 of one of the thread take-up levers 90.

As shown in FIG. 3, the thread take-up lever drive motor 70 is mounted on a part of the machine arm 12. A drive shaft 72 of the drive motor 70 and a substantially middle portion of the drive lever 76 are connected to each other by link members 74 and 75. Thus, when the drive shaft 72 of the drive motor 70 is reciprocally rotated, the drive lever 76 pivots around the support shaft 78, so that the thread take-up lever 90 of the selected one of the needle bars 60 reciprocally pivots around the thread take-up lever shaft 92.

The link member 74 is biased by a torsion spring 82 shown in FIG. 2 and FIG. 3. By the biasing force of the torsion spring 82, the link member 74 is normally kept at a position indicated by a solid line in FIG. 3 where it abuts on a stopper 73 fixed to a motor bracket 71 of the thread take-up lever drive motor 70.

The thread take-up lever drive motor 70 is normally constructed by a pulse motor, and therefore, the torsion spring 82 is normally not required. However, there is some possibility that the drive motor 70 operates out of control when it is driven under open loop control and when an excessive load is applied to the drive motor 70. Thus, by returning the link member 74 to the position indicated by the solid line in FIG. 4 through the torsion spring 82 for each drive control operation of the thread take-up controlled operation of the drive motor 70 can be recovered from out-of-control condition.

A sewing operation of the above thread take-up lever driving device will now be explained. When the main shaft drive motor 15 is driven to rotate the main shaft 14, the selected one of the needle bars 60 is vertically reciprocally moved together with the needle bar drive member 44. Simultaneously therewith, the thread take-up lever drive motor 70 and the shuttle drive motor 132 are driven under control.

As the thread take-up lever drive motor 70 is thus driven, one of the thread take-up levers 90 corresponding to the selected one of the needle bars 60 is reciprocally pivoted so as to change the tension applied to the upper thread in response to the vertical movement of the selected needle bar 60 and in response to the rotation of a shuttle (not shown) driven by the shuttle drive motor 132.

Further, as the selected needle bar 60, its corresponding thread take-up lever 90 and the shuttle are thus operated, an embroidery frame 138 shown in FIG. i is moved under control of the embroidery control device 100 in X and Y directions, so that a predetermined embroidery sewing operation is performed.

In the case where the color change motor 135 is driven based on a color change signal from the embroidery control device 100, the needle bar case 50 is moved along the front side of the machine arm 12 so as to select another needle bar 60, and the pin 64 of the needle bar holder 62 is engaged between the engaging protrusions 48 of the needle bar drive member 44.

Simultaneously therewith, another thread take-up lever 90 corresponding to the newly selected needle bar 60 is also selected. Thus, the recess 94 of such another thread take-up lever 90 is disengaged from the stopper rail 13, and the roller 80 of the drive lever 76 engages the recess 96 of the selected thread take-up lever 90.

The selected thread take-up lever 90 is driven under control as will be hereinafter explained with reference to FIGS. 5 to 8 which show operation timings, at various sewing conditions, of the selected needle bar 60, the selected thread take-up lever 90 and the shuttle with respect to the rotational angle of the main shaft 14 (abscissa).

Figure 5:
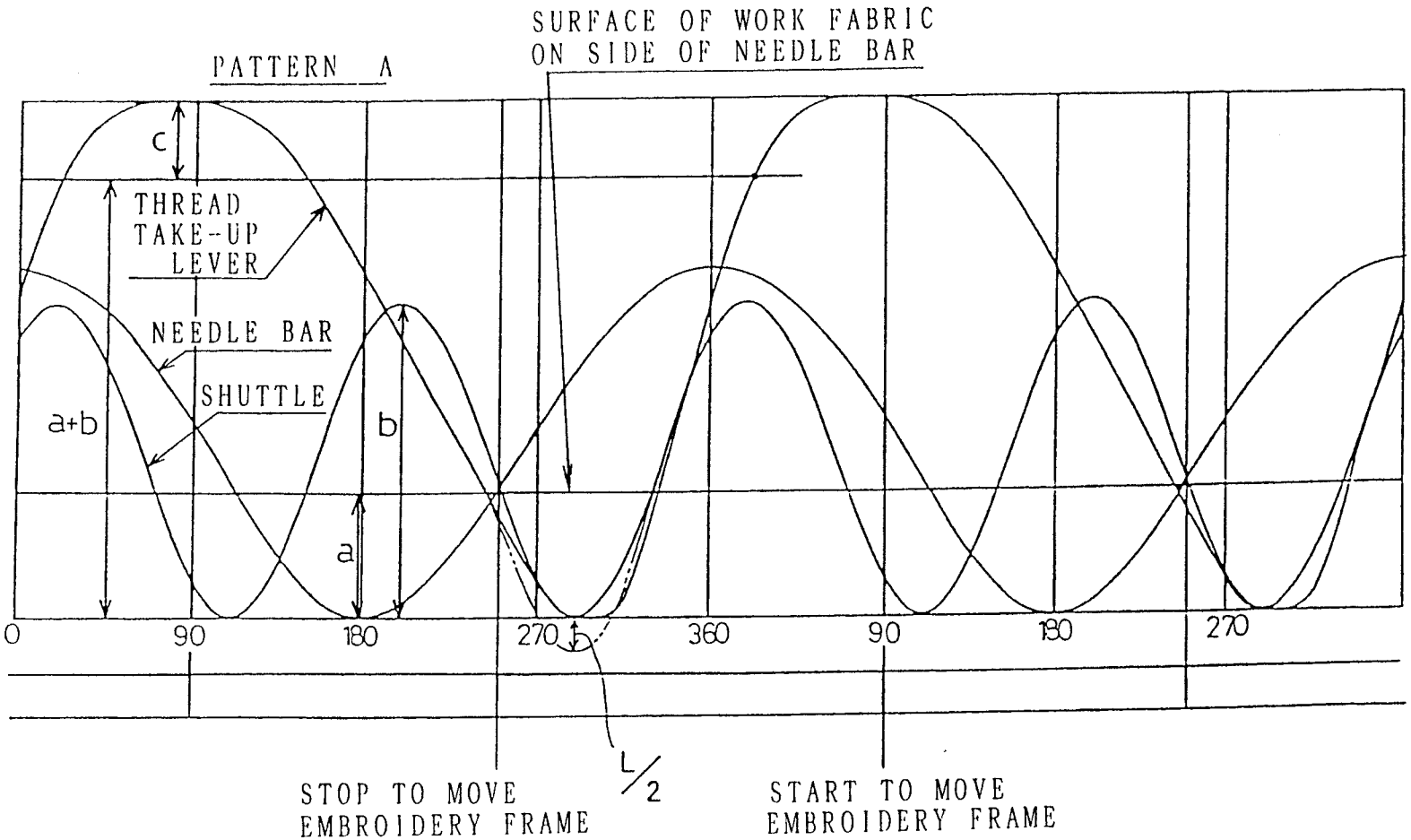
FIG. 5 is a graph showing operation timings, for a normal sewing operation, of a needle bar, a thread take-up lever and a shuttle with respect to the rotational angle of a main shaft.

In FIGS. 5 to 8, particularly in FIG. 5, a stroke part a of the vertical stroke of the needle bar 60 corresponds to the period until the sewing needle 68 reaches its lower dead center after it has been stuck into a work fabric (not shown). A stroke part b corresponds to a vertical stroke of the hook of the shuttle. The sum value (a+b) of these strokes a and b corresponds to a length of the upper thread required for sticking of the sewing needle 68 to extend downwardly from the work fabric in addition to a length of the same required for engagement by the hook of the shuttle and for subsequent withdrawal into the shuttle.

The upper thread is taken up by the thread take-up lever 90 through upper pivotal movement of the thread take-up lever 90. A further upward stroke c of the thread take-up lever 90 serves to draw out the upper thread from an upper thread supply device for formation of the next stitch and simultaneously to tighten the upper thread. Thus, the sum of the strokes a, b and c is a basic stroke of the thread take-up lever 90.

A stitch length L of each stitch for a normal sewing pattern as shown in FIG. 5 (hereinafter called "Pattern A") is calculated by the following expression based on the amount of movement of the embroidery frame in X and Y directions:

$$L = K \times \sqrt{X^2 + Y^2} \quad \text{[Expression 1]}$$

In this Expression 1, K is a constant determined by the quality or a thickness of the upper thread or the work fabric. The value K is inputted to the CPU 101 through operation of the keys of the operation panel 140 shown in FIG. 1 before starting the sewing operation.

For the sewing operation of the Pattern A, the stroke of the thread take-up lever 90 for each stitch is determined as the sum of the basic stroke (a+b+c) and half the stitch length L obtained by the above Expression 1 (L/2) so as to change the lower dead center by the stroke L/2. The upper thread is tightened through the pivotal movement of the thread take-up lever go after the lower dead center. Thus, with the above determination of the stroke, the timing of tightening of the upper thread can be be adjusted to have a constant relationship relative to the timing of starting of movement of the embroidery frame 138. Further, since the constant K is incorporated in the calculation of the stitch length L, shrinkage of the work fabric made of stretchable material such as a knit can be eliminated by the controlled stroke of the thread take-up lever 90.

Here, the reason of the incorporation of the stroke L/2 to the stroke of the thread take-up lever 90 is that the upper thread passed through the thread take-up lever 90 is turned at the passing position.

A pattern of control for a one-stitch jumping operation shown in FIG. 6 (hereinafter called "pattern B") is now explained. With this jumping control, a jumping signal is turned on immediately after the needle bar 60 has started to move upwardly. Based on this signal, an actuator such as a solenoid is actuated to pivot the needle bar drive member 44 around the axis of the base needle bar 40. The engaging protrusions 48 are therefore disengaged from the pin 64 immediately before the needle bar 60 reaches an upper dead center, so that the transmission of driving power from the drive base 42 to the needle bar 60 is stopped.

The needle bar 60 is thus maintained at the upper dead center until the jumping signal is turned off to permit downward movement of the needle bar 60 after the jumping signal has turned on. Thus, the basic stroke of the thread take-up lever 90 for the Pattern B may have a value "0". The stitch length L during the jumping operation may be calculated in the same manner as for the Pattern A, and the thread take-up lever 90 is gradually downwardly pivoted by the stroke L/2 in response to the starting of movement of the embroidery frame 138. Consequently, the strong tension may not be applied to the upper thread when the embroidery frame 138 is moved.

Figure 6:
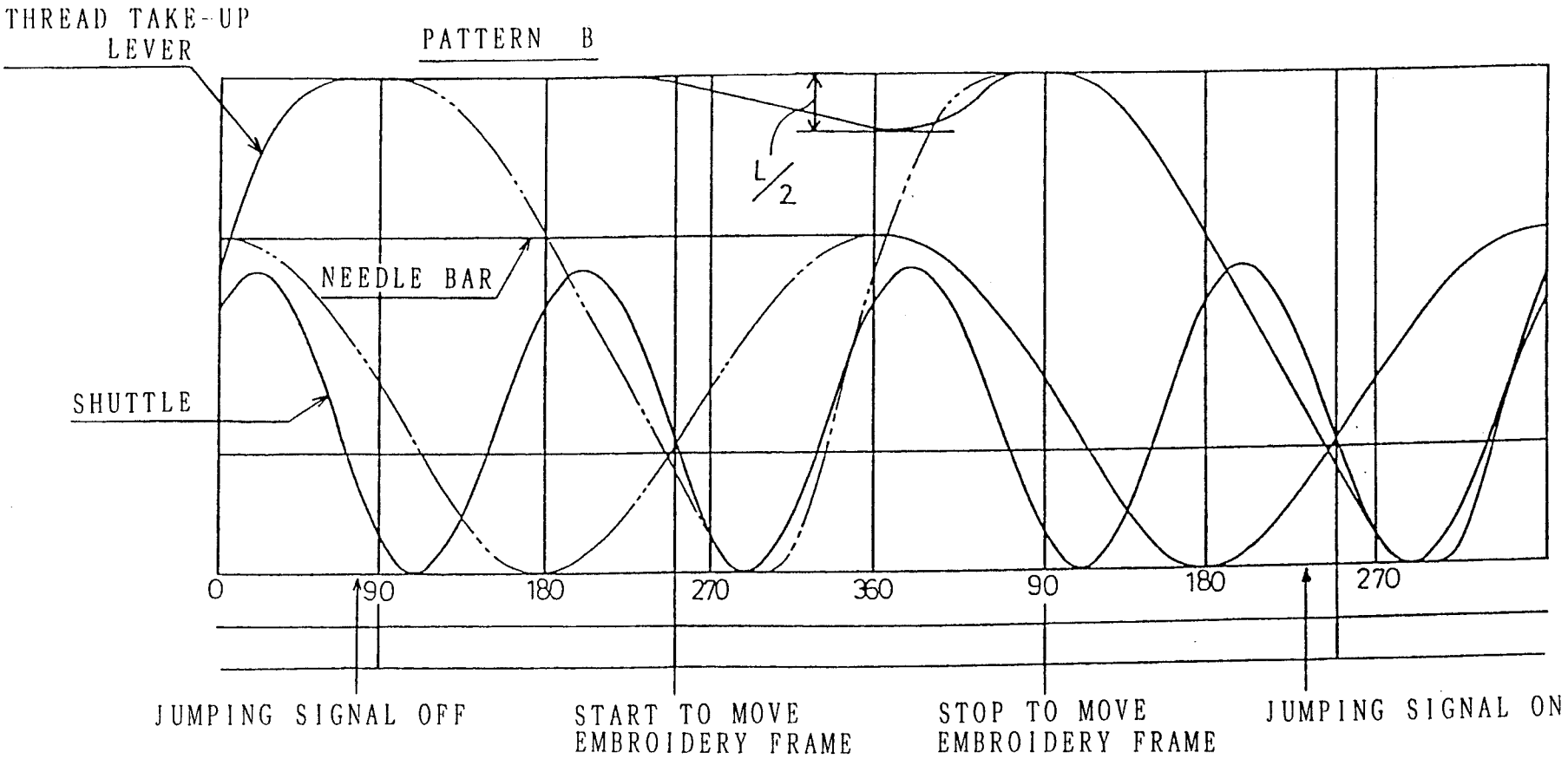
FIG. 6 is a graph showing operation timings, for a jumping operation, of the needle bar, the thread take-up lever and the shuttle with respect to the rotational angle of the main shaft.

Since the timing shown in FIG. 6 is determined for the one-stitch jumping operation, the thread take-up lever 90 is smoothly moved toward the upper dead center after it has been pivoted downwardly by the stroke L/2. The sewing pattern is thereafter returned to the Pattern A. If the jumping operation is to be performed in series, the control under the Pattern B is repeated.

As described above, since needless pivotal movement of the thread take-up lever 90 is eliminated in the Pattern B, entanglement or breakage of the upper thread may not be caused. Further, if the sewing machine is a multi-head sewing machine having a plural number of sewing heads 10, the thread take-up levers 90 of the non-operating sewing heads 10 can be controlled not to pivot.

Figure 7:
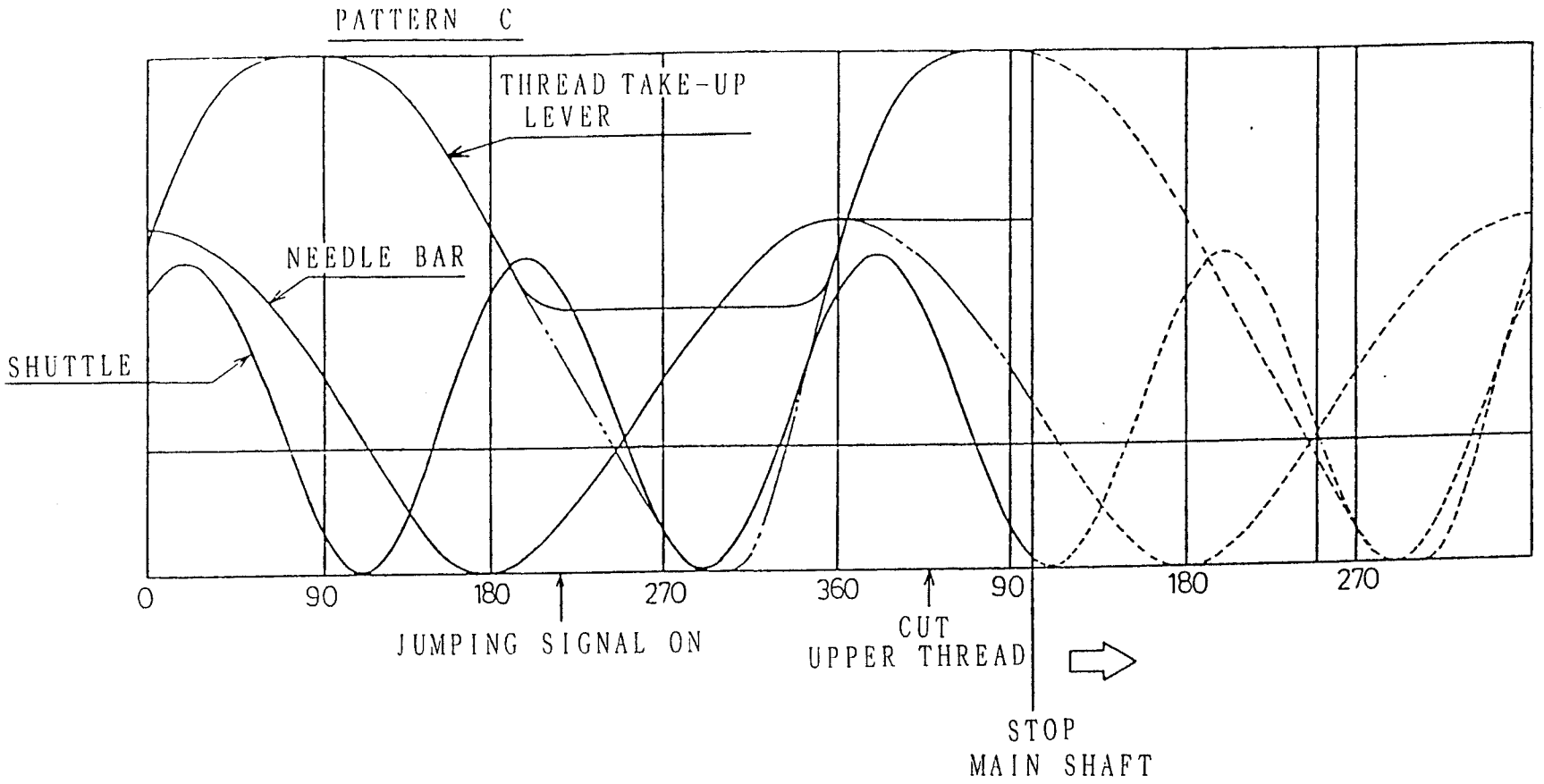
FIG. 7 is a graph showing operation timings, for thread cutting operation, of the needle bar, the thread take-up lever and the shuttle with respect to the rotational angle of the main shaft.

A pattern of control for the thread cutting operation (hereinafter called "Pattern C") will now be described with reference to FIG. 7. The hook of the shuttle engages the upper thread when the main shaft 14 has been rotated by about 200°, and the movement of the thread take-up lever 90 is thereafter stopped so as to permit withdrawal of the upper thread from the supply device through further rotation of the shuttle. Therefore, by adjusting the stop timing of the thread take-up lever 90, the length of the remaining upper thread on the side of the sewing needle 68 after the thread cutting operation can be selectively determined.

The needle bar 60 reaches the upper dead center after the thread take-up lever 90 has been stopped, and the thread take-up lever 90 starts to move upwardly according to the Pattern A immediately before the needle bar 60 reaches the upper dead center. The thread cutting operation is performed before the thread take-up lever 90 reaches the upper dead center, and the rotation of the main shaft 14 is stopped when the thread take-up lever 90 reaches the upper dead center. At the time when the rotation of the main shaft 14 has been stopped, the needle bar 60 is maintained at the upper dead center according to the jumping signal.

Figure 8:
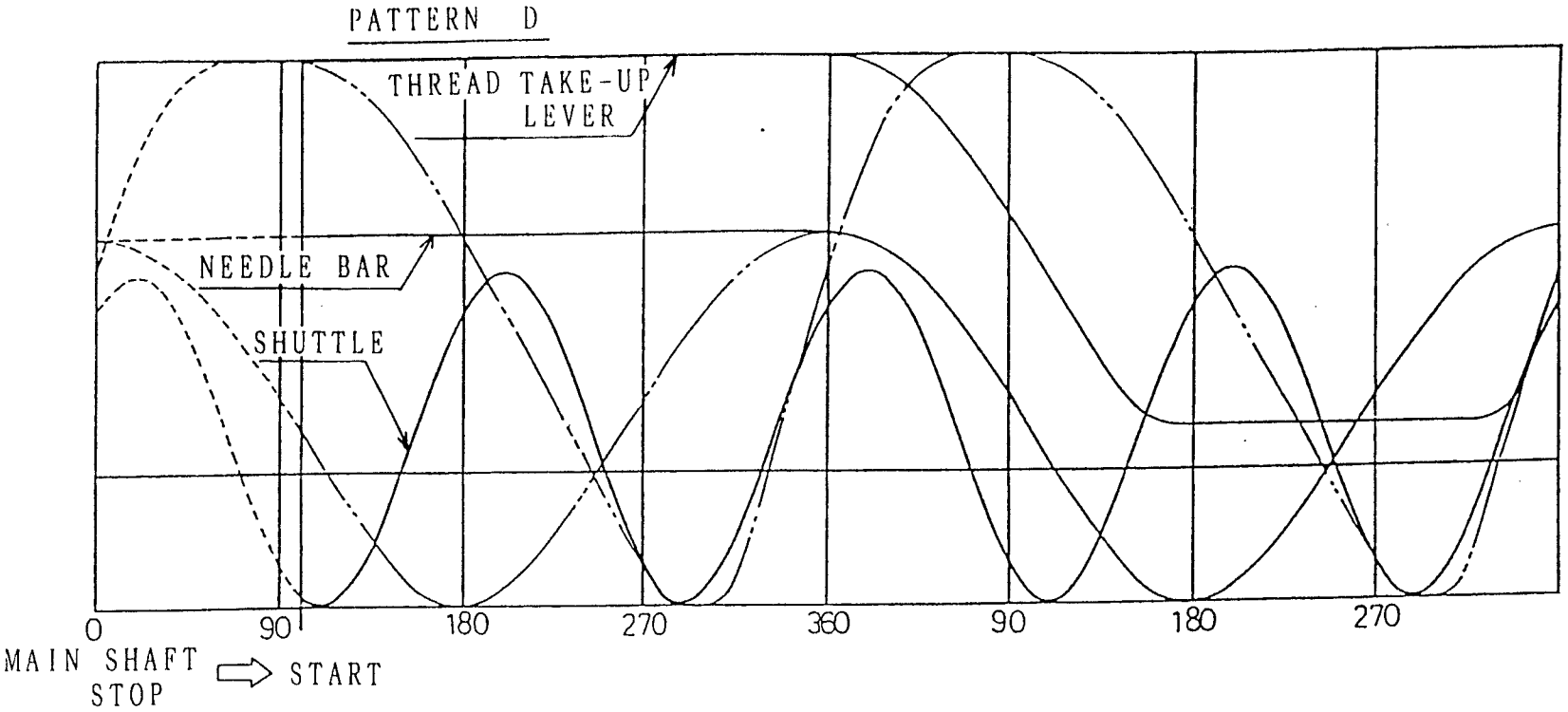
FIG. 8 is a graph showing operation timings, for sewing start operation, of the needle bar, the thread take-up lever and the shuttle with respect to the rotational angle of the main shaft.

Finally, a control pattern for starting the sewing operation (hereinafter called "Pattern D") will now be explained with reference to FIG. 8. By the operation of the start switch 131 shown in FIG. 1, the main shaft 14 starts to rotate. As the needle bar 60 maintained at the upper dead center is caused to move downwardly, the thread take-up lever 90 is also caused to move from the upper dead center.

The downward movement of the thread take-up lever 90 at the beginning of the sewing operation is stopped when the sewing needle 68 reaches around the lower dead center through downward movement of the needle bar 60. As a result of this operation, the end portion of the remaining upper thread on the side of the sewing needle 68 after the thread cutting operation is withdrawn below a throat plate by the subsequent operation of the shuttle. This may prevent the end portion of the remaining upper thread from being exposed on the surface of the work fabric.

Figure 9:
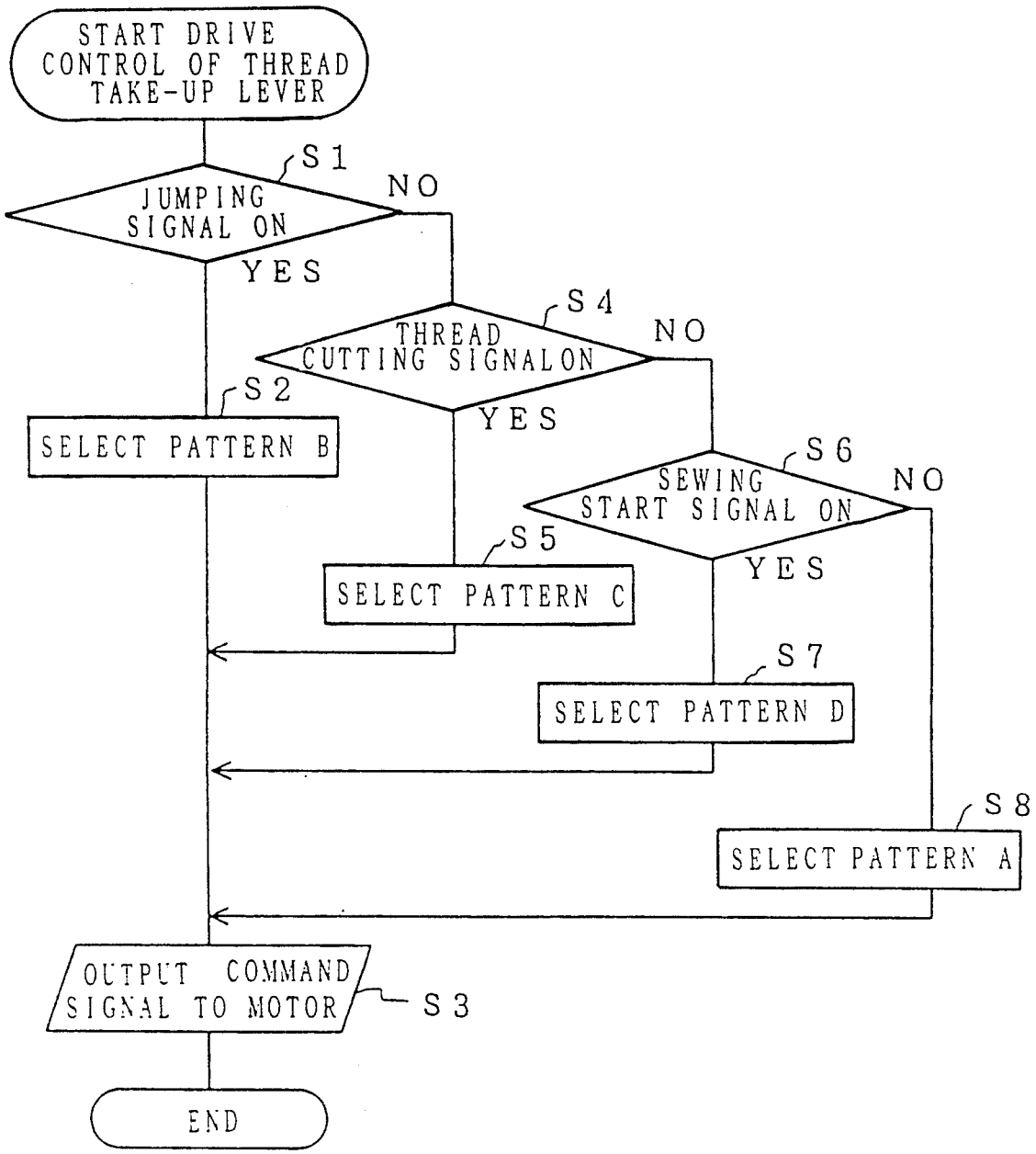
FIG. 9 is a flowchart showing process of control for the movement of the thread take-up lever.

The drive control of the thread take-up lever 90 which is performed by the CPU 101 of the embroidery control device 100 will now be explained with reference to a flowchart shown in FIG. 9. First, in Step S1, the CPU 101 determines as to whether the jumping signal is on or off. If the jumping signal is on, the process proceeds to Step S2 to select the Pattern B. Subsequently, a command signal corresponding to the Pattern B is outputted to the motor driver 128 of the thread take-up lever drive motor 70 in Step S3, and the process is then finished.

If the jumping signal is off in Step S1, the CPU 101 determines as to whether a thread cutting signal is on or off in Step S3. If the thread cutting signal is on, the process proceeds to Step S5 to select the Pattern C. Subsequently, a command signal corresponding to the Pattern C is outputted to the motor driver 128 in Step S3, and the process is then finished.

If the thread cutting signal is off in Step S4, the CPU 101 determines as to whether a sewing start signal is on or off in Step S6. If the sewing start signal is on, the process proceeds to Step S7 to select the Pattern D. Subsequently, a command signal corresponding to the Pattern D is outputted to the motor driver 128 in Step S3, and the process is then finished.

If the sewing start signal is off in Step S6, the process proceeds to Step S8 to select the Pattern A. Subsequently, a command signal corresponding to the Pattern A is outputted to the motor driver 128 in Step S3, and the process is then finished.

Although in this embodiment, it is not referred to a control to change the operation timing of the thread take-up lever 90 in the Pattern A, the motion itself of the thread take-up lever 90 in the Pattern A can be changed.

Figure 10:
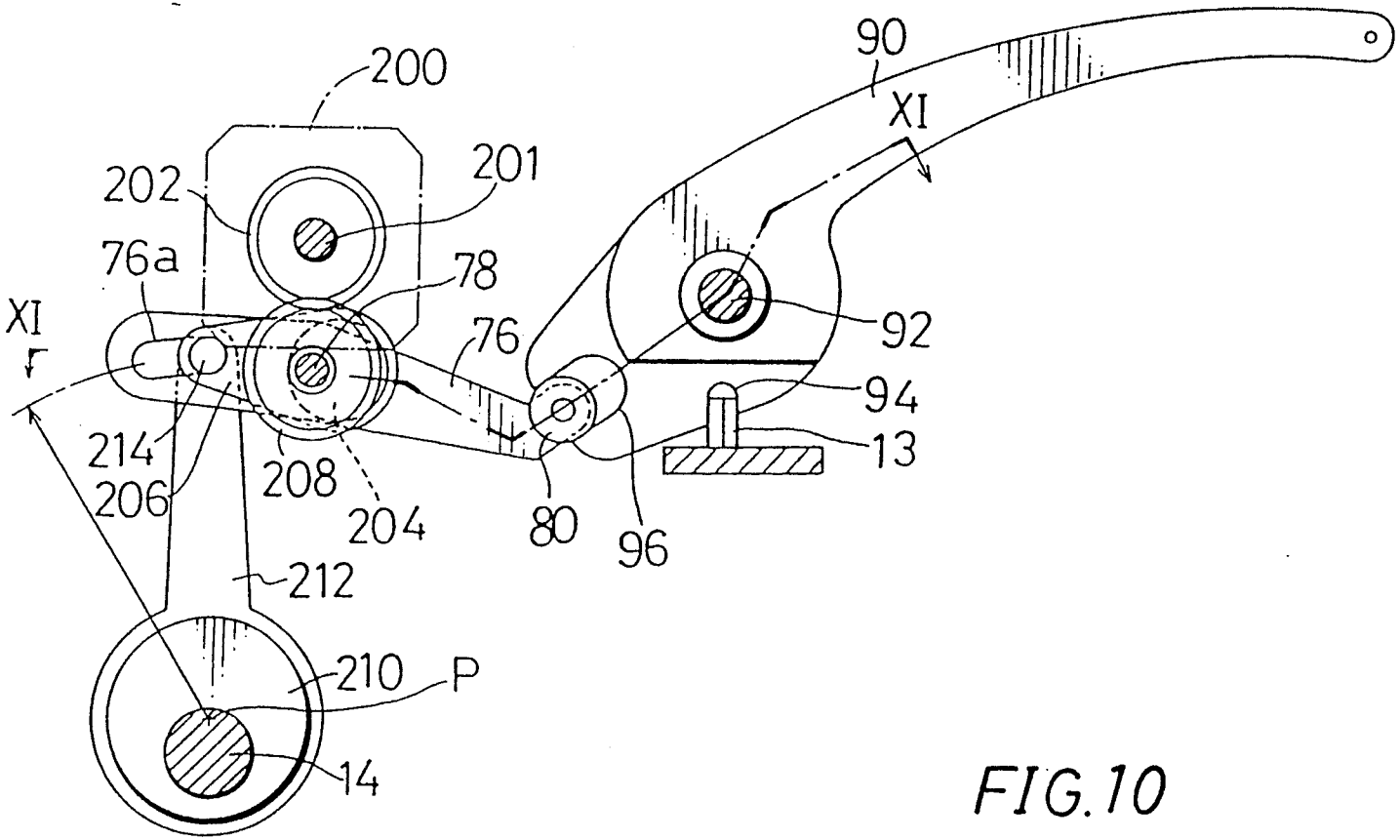
FIG. 10 is a side view of a main part of the thread take-up lever driving device according to a second embodiment of the present invention.
Figure 11:
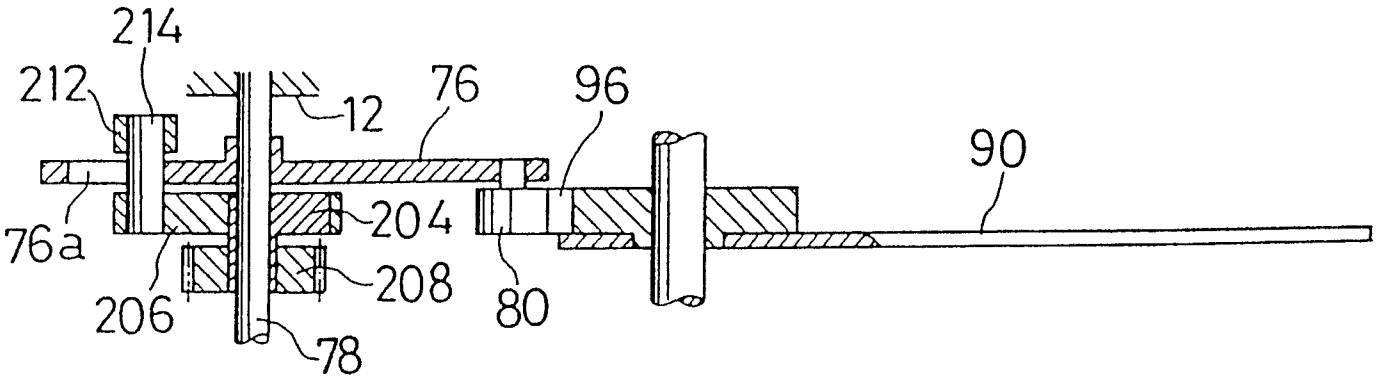
FIG. 11 is a sectional view taken along line X1—X1 in FIG. 10.

A second embodiment of the thread take-up lever drive device according to the present invention will now be explained with reference to FIGS. 10 and 11 which show a side view of the device and a sectional view taken along line X1—X1 in FIG. 10, respectively. This embodiment is a modification of the first embodiment, and an explanation of the same members as the first embodiment is omitted by affixing the same numerals in FIGS. 10 and 11. In this embodiment, the pivotal movement of a thread take-up lever 90 is performed by driving a main shaft 14 as the first embodiment. The stroke of the pivotal movement of the thread take-up lever 90 is however adjustable by a control motor 200.

The middle portion of a drive lever 76 for the thread take-up lever 90 is rotatably supported by a support shaft 78 which is fixed to a machine arm 12. One end of the drive lever 76 includes a roller 80 for engagement with a recess 96 of the thread take-up lever 90 as the first embodiment. The other end of the drive lever 76 includes an engaging slot **76*a***.

An eccentric cam 204 is rotatably mounted on the support shaft 78 and is slidably inserted into one end of a cam lever 204. A driven gear 208 is fixed to a boss portion of the eccentric cam 204 so as to rotate therewith. A motor gear 202 is fixed to a motor shaft 201 of the control motor 200 and is in engagement with the driven gear 208.

A thread take-up lever drive cam 210 is fixed on the main shaft 14. The drive cam 210 is slidably inserted into one end of a rod 212, so that the rod 212 is reciprocally moved in response to the rotation of the drive cam 210. The other end of the rod 212 is connected to the other end of the cam lever 206 through a pin 214 which is in engagement with the engaging slot **76*a* of the drive lever 76. As shown in FIG. 10, the engaging slot 76*a* is determined to have a circular-arc configuration, the center of which corresponds to a center P of the pivotal movement of the rod 212 when the rod 212 (and the thread take-up lever 90**) is at the upper dead center.

With this embodiment, when the rod 212 is reciprocally moved in response to the rotation of the thread take-up lever drive cam 210, the drive lever 76 is pivoted around the support shaft 78 through the pin 214, so that the thread take-up lever 90 is reciprocally pivotally moved. To change the stroke of the pivotal movement of the thread take-up lever 90, the control motor 200 is driven to rotate the eccentric cam 204 through engagement between the motor gear 202 and the driven gear 208. The position of the pin 214 is then changed through movement of the cam lever 206, so that the leverage of the drive lever 76 can be adjusted.

Thus, the stroke of pivotal movement of the thread take-up lever 90 becomes maximum when the pin 214 engages the rightmost end of the engaging slot **76*a* of the drive lever 76, and the stroke is gradually decreased as the engaging position of the pin 214 is moved leftwardly. Here, even if pin 214 is moved when the rod 212 or the thread take-up lever 90 is at the upper dead center as shown in FIG. 10, the drive lever 76 may not pivot but the pin 214 merely moves along the engaging slot 76*a***. Therefore, the pivotal stroke can be adjusted without changing the position of the upper dead center.

While the invention has been described with reference to preferred embodiments thereof, it is to be understood that modifications or variations may be easily made without departing from the scope of the present invention which is defined by the appended claims.

We claim:

1. A thread take-up lever driving device in a sewing machine including a needle bar, a shuttle driven by a main shaft and a thread take-up lever vertically reciprocally movable for performing a sewing operation in cooperation with the needle bar and the shuttle, comprising:

a stroke adjusting means for adjusting the magnitude of the vertical stroke of the thread take-up lever; and control means for controlling said stroke adjusting means to correspond to a pattern of stroke movement of the thread take-up lever, said pattern being determined based on a sewing condition.

2. The thread take-up lever driving device as defined in claim 1 wherein said stroke adjusting means includes drive means for driving the thread take-up lever independently of the main shaft; and said control means controls said drive means.

3. The thread take-up lever driving devise as defined in claim 2 wherein said control means is a CPU, and wherein said drive means is a motor controlled by a control signal outputted from said CPU.

4. A thread take-up lever driving device in a sewing machine including a needle bar and a shuttle driven by a main shaft, a thread take-up lever vertically reciprocally movable for performing a sewing operation in cooperation with the needle bar and the shuttle, comprising: stroke adjusting means for adjusting the magnitude of the vertical stroke of the thread take-up lever, and control means for controlling said stroke adjusting means to correspond to a pattern of stroke movement of the thread take-up lever, said pattern being determined according to a sewing condition;

said stroke adjusting means including a cam-lever mechanism provided between the main shaft and the thread take-up lever for converting the rotation of the main shaft into the vertical reciprocal movement of the thread take-up lever, and said control means is operable to change the leverage of said cam-lever mechanism.

5. A thread take-up lever driving device in an embroidery machine including a plurality of needle bars and a shuttle driven by a main shaft and including a plurality of thread take-up levers, one of the needle bars and one of the corresponding thread take-up levers being driven for performing a sewing operation in cooperation with the shuttle, comprising: stroke adjusting means for adjusting the magnitude of a vertical stroke of the selected thread take-up lever, and control means for controlling said stroke adjusting means to correspond to a pattern of stroke movement of the selected thread take-up lever, said pattern being determined according to a sewing condition.

6. The thread take-up lever driving device as defined in claim 5 wherein said pattern of stroke is selected from a plurality of patterns including a first pattern for a normal sewing operation, a second pattern for a jumping operation, a third pattern for a thread cutting operation and a fourth pattern for a sewing starting operation.

* * * * *